United States Patent [19]

Frentzel-Beyme

[11] Patent Number: 4,848,075

[45] Date of Patent: Jul. 18, 1989

[54] METHOD OF ADJUSTING THE TENSILE FORCE RATIO BETWEEN AN OUTER THREAD AND AN INNER THREAD WHEN MANUFACTURING CABLED INDUSTRIAL YARNS, AND AN APPARATUS FOR IMPLEMENTING THIS METHOD

[75] Inventor: Johannes Frentzel-Beyme, Monchen-Gladbach, Fed. Rep. of Germany

[73] Assignee: Palitex Project Company GmbH, Krefeld, Fed. Rep. of Germany

[21] Appl. No.: 166,108

[22] Filed: Mar. 10, 1988

[30] Foreign Application Priority Data

Mar. 14, 1987 [DE] Fed. Rep. of Germany ..... 3708331

[51] Int. Cl.[4] ..... D01H 7/00; D01H 7/88; D01H 13/32; D02G 3/28

[52] U.S. Cl. ..... 57/264; 57/58.3; 57/58.36; 57/265; 73/160

[58] Field of Search ..... 57/58.3–58.38, 57/352, 264, 265; 73/159, 160

[56] References Cited

U.S. PATENT DOCUMENTS

| | | | |
|---|---|---|---|
| 2,343,535 | 3/1944 | Clarkson | 57/58.3 |
| 2,400,697 | 5/1946 | Lewis | 57/58.3 |
| 2,939,267 | 6/1960 | Klein | 57/58.3 |
| 2,942,404 | 6/1960 | Grangie | 57/58.3 |
| 3,336,740 | 8/1967 | Vibber | 57/58.36 |
| 3,339,358 | 9/1967 | Vibber | 57/58.36 |

FOREIGN PATENT DOCUMENTS

| | | |
|---|---|---|
| 8407900 | 8/1985 | Fed. Rep. of Germany . |
| 3628654 | 3/1988 | Fed. Rep. of Germany . |

*Primary Examiner*—John Petrakes

*Attorney, Agent, or Firm*—Bell, Seltzer, Park & Gibson

[57] ABSTRACT

A method and apparatus for automatically adjusting the tensile force ratio between axially moving outer and inner threads of cabled yarn during manufacture of such yarn in a cabling machine in which the actual tensile force ratio is measured in the region of the thread guide eye of the cabling machine, such measured tensile force ratio is compared with a desired tensile force ratio and the thread guide eye of the cabling machine is axially adjusted to provide a desired height of the thread balloon in the yarn cabling machine to provide a desired outer and inner thread tensile force ratio. Suitable apparatus, preferably in the form of a hand held instrument is provided for automatically performing such adjustment of the tensile force ratio.

10 Claims, 2 Drawing Sheets

Fig. 3
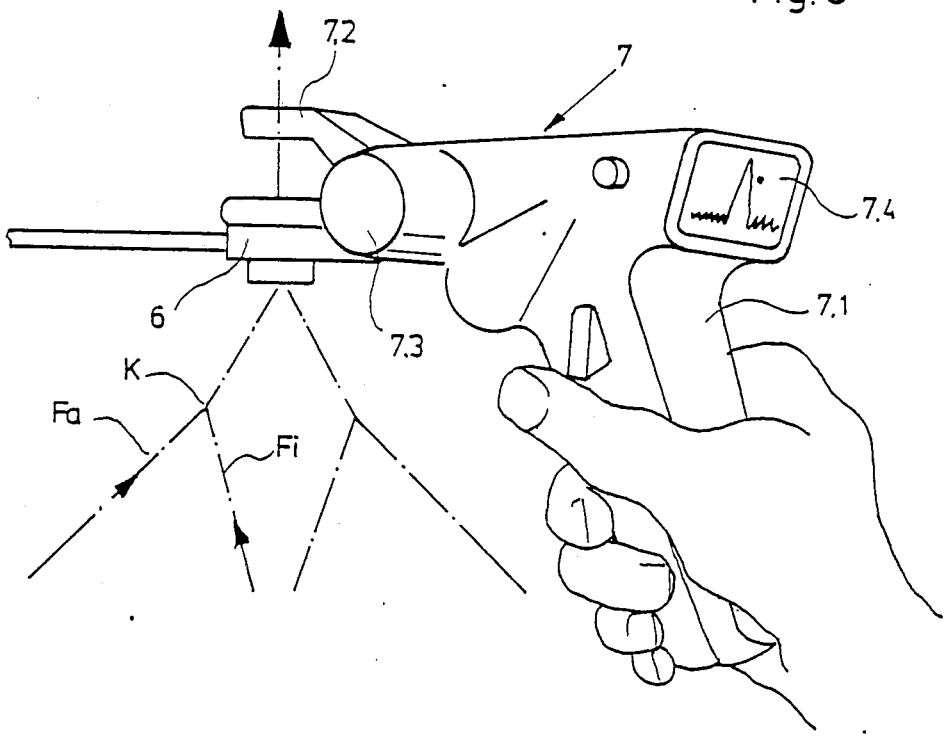
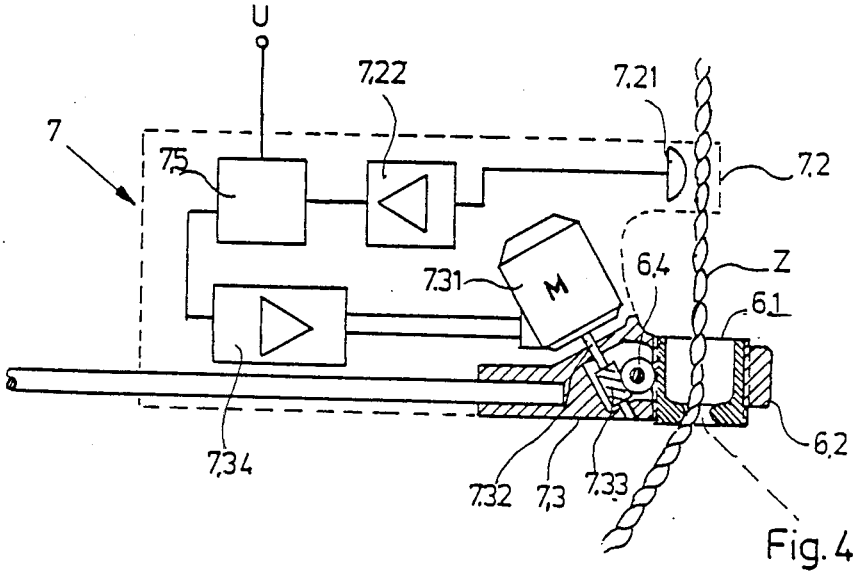
Fig. 4

METHOD OF ADJUSTING THE TENSILE FORCE RATIO BETWEEN AN OUTER THREAD AND AN INNER THREAD WHEN MANUFACTURING CABLED INDUSTRIAL YARNS, AND AN APPARATUS FOR IMPLEMENTING THIS METHOD

FIELD AND BACKGROUND OF THE INVENTION

The invention relates to a method for adjusting the tensile force ratio between an outer thread and an inner thread during the manufacture of cabled industrial yarns by means of an apparatus in which an outer thread and an inner thread are combined in the region of a thread balloon to be twisted together and the yarn subsequently runs through a thread guide eye.

Such a method is known and is described, for example, in DE-GM No. 84 07 900.

During the manufacture of cabled industrial yarns, for example tyre cord, it is extremely important for the outer and inner threads to have a predetermined tensile force ratio, so that the two yarn components are processed with a particular, preferably constant, length ratio. The position of the cording point in the region of the thread guide eye is of particular importance for this. Of the two yarn components, the outer thread runs through the thread balloon, while the inner thread is conveyed from a bobbin pot by way of a brake system into the vicinity of the vertex of the thread balloon. If the cording point changes its position as a result of a variation in tensile forces of the outer thread and the inner thread, the two yarn components will simultaneously wind around each other in a different ratio.

OBJECT AND SUMMARY OF THE INVENTION

The object of the invention is to develop a method of the type described at the beginning in such a way that in the course of the operation, that is without stopping the thread balloon, a predetermined tensile force ratio is set and maintained, or can also be altered by a predetermined value. It is a particular object of the invention to set the lengths of the two yarn components to be processed to a particular, preferably constant value and to maintain them at this value.

This object is achieved in accordance with the present invention by providing an apparatus and method for automatically adjusting the tensile force ratio between axially moving outer and inner threads of cabled yarn during manufacture of such yarn in a cabling machine which includes axially-aligned spindle means and thread guide eye means for forming therebetween a rotating balloon of the axially moving outer thread, means for supplying the inner thread from within the outer thread balloon to a cording point below the thread guide eye means for winding the outer and inner threads about each other for cabling of the threads prior to passing through the thread guide eye means, and means for axially moving the thread guide eye means to vary the height of the thread balloon and the tensile force ratio between the outer and inner threads of the cabled yarn.

The method includes the steps of measuring the actual tensile force ratio between the outer and inner threads in the region of the thread guide eye means, comparing the measured tensile force ratio with a desired tensile force ratio, and adjusting the axial position of the thread guide eye means to provide a desired height of the thread balloon so that the measured tensile force ratio is the same as the desired tensile force ratio.

The apparatus includes means adapted to be positioned in the region of the thread guide eye means for measuring the actual tensile force ratio between the outer and inner threads. Evaluation means are operatively connected with the measuring means for comparing the measured tensile force ratio with a desired tensile force ratio and for producing an adjusting signal as a function of such comparison. Means are operatively connected with the evaluation means and are adapted to be cooperatively connected with the thread guide eye moving means for receiving the adjusting signal from the evaluation means and for cooperating with the thread guide eye moving means for automatically adjusting the axial position of the thread guide eye means to provide a desirable height of the thread balloon and a desirable outer and inner thread tensile force ratio.

Preferably, the means for axially moving the thread guide eye means may comprise a rack on the thread guide eye means and a rotatable gear wheel in driving engagement with the rack. The means cooperating with the thread guide eye moving means for automatically adjusting the axial position of the thread guide eye means may comprise a servo motor for receiving and being operated by the adjusting signal from the evaluation means, and worm gear means driven by the servo motor means and adapted to engage and drive the rotatable gear wheel.

Preferably, the measuring means may comprise sensing means adapted to be positioned at a fixed point beyond the thread guide eye means in the path of the moving cabled yarn for measuring the difference in length between the outer and inner threads of the cabled yarn and for emitting an electrical output signal corresponding to such measurement in the evaluation means.

The apparatus is preferably in the form of a hand-held and operated instrument which can be placed in the yarn cabling machine. The apparatus may preferably include means for visually displaying the comparison between the measured tensile force ratio and the desired tensile force ratio as determined by the cabling machine. The apparatus may preferably include means for visually displaying the comparison between the measured tensile force ratio and the desired tensile force ratio as determined by the evaluation means.

The tensile force ratio of the threads may be determined from the absolute values of the tensile forces of the thread. This tensile force ratio may also be determined by the angle at which the threads combine, or the symmetry of the angle in the thread balloon, as measured for at least one of the threads. The twist structure of a yarn is determined in accordance with a proposal which is described in an older application DE-OS No. 36 28 654. It is assumed that any difference in the length of the yarn components due to an unequal ratio of thread tensile forces can be observed in determining the twist structure.

In the older method, the periodicity of the twist structure is sensed. A double twist whose two yarn components are of unequal length is characterised by the fact that, for each twist period, the longer thread has larger bulges to the side than the shorter thread. When the twist structure is being sensed, these lateral bulges do not cause two identical fluctuations in amplitude to occur per twist period in the output signal of the sensing device, but one stronger amplitude and one weaker amplitude. The output signal thus contains not only the basic frequency corresponding to a half period, but also a first subharmonic, which corresponds to a simple twist period. The intensity of this subharmonic is an indication of the difference in lengths of the yarn components, and hence also an indication of the difference in the tensile force ratio of the two yarn components. Reference is made to the older application (DE-OS No. 36 28 654) for details of this older method, particularly as regards evaluation of the signal obtained.

In addition to precise monitoring and adjusting of the tensile force of the threads during operation, the apparatus according to the invention also allows sensitive adjustment of the height of the thread guide eye, because said thread guide eye can be adjusted axially. This is primarily of important in devices which have a plurality of twist bobbins and a corresponding plurality of thread guides, whereby, in general, the thread guides are disposed on a common device for coarse adjustment. Unavoidable tolerances in the dimensions of the twist spindles mean that, in these apparata, each thread guide eye is on a somewhat different level in relation to its twist spindle. Since the height of the thread guide eye relative to the twist spindle affects the tensile force of the thread, the result is that there is a somewhat different tensile force ratio between the outer thread and the inner thread on each twist spindle. This disadvantage can be eliminated by means of appropriate individual sensitive adjustment to each of the thread guide eyes, which are axially adjustable. Hence, each thread guide eye can be adjusted to a predetermined value before commencement of the twisting operation, and this value can be checked and readjusted during the twisting operation using the method according to the invention.

BRIEF DESCRIPTION OF THE DRAWINGS

The method according to the invention as well as an apparatus for carrying out said method are further described below with reference to the accompanying drawings, in which:

FIG. 3 is a schematic, partly perspective view of a hand-operated instrument used in FIGS. 1 and 2, having an apparatus for measuring and adjusting the tensile force ratio between the outer thread and the inner thread; and FIG. 4 shows the individual devices of the hand-operated instrument in FIG. 3, partly in the form of a circuit diagram.

DESCRIPTION OF PREFERRED EMBODIMENT OF THE INVENTION

Figure 1:
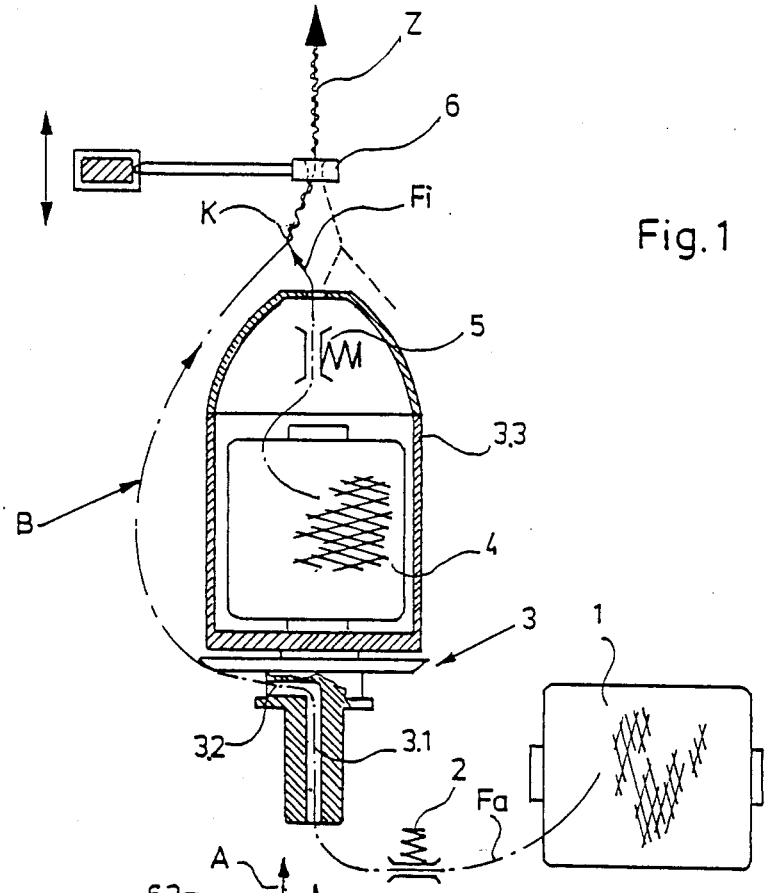
FIG. 1 is a highly schematic representation of the important parts of an apparatus for producing directly cabled industrial yarns.
Figure 2:
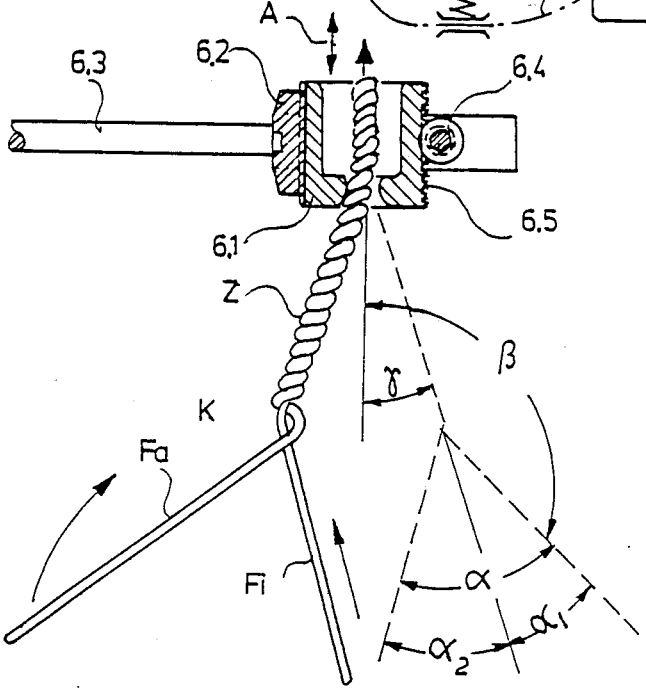
FIG. 2 shows the region of the thread guide eye of the apparatus in FIG. 1 on a larger scale than in FIG. 1.

FIG. 1 shows only those parts of apparatus for producing directly helically spun yarns (cabled industrial yarns) which are of importance for the method of adjusting the tensile force ratio between an outer thread Fa and an inner thread Fi. The outer thread Fa is drawn from a first supply bobbin 1. It runs through an indicated thread brake device 2, an axial passage 3.1, and a spindle 3, from which it emerges through a radial passage 3.2 to form a thread balloon B about the spindle. A thread guide eye 6 is disposed a little above the vertex of the thread balloon. The inner thread Fi is drawn from a second supply bobbin 4, arranged above the spindle 3 and inside a bobbin pot 3.3 within the thread balloon B and is supplied to a cording point K shortly below the thread guide eye 6. The inner thread Fi runs through a thread brake device 5 and emerges axially at the upper end of the bobbin pot 3.3. The outer thread Fa and inner thread Fi are wound around each other at the cording point K. FIG. 2 shows conditions in the region of the guide eye 6 and the cording point K in more detail.

As can be seen in FIG. 2, the twisted yarn Z, which is formed from the outer thread Fa and inner thread Fi, is guided through the thread guide eye 6 at the vertex of the thread balloon B. The actual eye part 6.1 is pot-shaped with an opening in the base and is displaceably guided by its side face in the axial direction A in a guide 6.2 on which is disposed a gear wheel 6.4 which engages in a rack 6.5 on the outside of the eye part 6.1. When the gear wheel 6.4 rotates, the eye part 6.1 is displaced in the axial direction A.

As can also be seen from FIG. 2, the outer thread Fa and inner thread Fi are brought together at the cording point K: the tensile force ratio between the two components determines the physical structure of the resulting yarn (their filamentary fine structure), the compactness of twist produced determines the angle $\alpha$ between the outer thread Fa and the inner thread Fi, and the shape of the balloon of the outer thread determines the angle $\beta$. The direction of the cable twisted thread divides the angle $\alpha$ at which the threads join into the two component angles $\alpha_1$ and $\alpha_2$. The ratio of these two component angles depends only on the tensile force ratio of the threads. Hence, in the arrangement shown in FIG. 2, the tensile force ratio between the outer thread Fa and the inner thread Fi may, for example, be determined in that the angles $\alpha_1$ and $\alpha_2$ are automatically measured directly below the thread guide eye 6 and a signal is produced from the measured values obtained, which represents the tensile force ratio between the threads. This signal can be compared with a desired value and a control signal can be produced, which is fed to an adjusting device (not shown), for example an adjusting motor, which engages with the gear wheel 6.4 and causes a corresponding axial adjustment of the eye part 6.1.

An alternative method of determining the tensile force ratio between the outer thread Fa and the inner thread Fi is to sense the twist structure of the yarn Z formed from the two individual components, for example directly above the thread guide eye 6.

As already mentioned, this twist structure is affected by the tensile forces of the threads in such a way that, when it is sensed, a periodic signal is obtained which contains a component which has a half basic frequency corresponding to the wavelength of the yarn period and whose relative intensity is an indicator of the difference in length between the two yarn components and hence also of the difference in tensile force between the two yarn components. It is thus possible to produce a signal from this component which represents the tensile force ratio between the threads, which signal can in turn be compared with a desired value. A control signal can be produced from this comparison and fed to an adjusting device, which engages with the gear wheel 6.4, as a result of which a corresponding axial displacement of the eye part 6.1 is effected.

A device of the latter type and its method of operation will be described below with reference to FIGS. 3 and 4.

FIG. 3 shows an apparatus 7, which is in the form of a hand-operated instrument, which can be put onto the device for producing directly cabled yarns, as shown in FIGS. 1 and 2, in the region of the thread guide eye 6. The instrument 7, which is provided with a handle 7.1, has a sensor head 7.2 on its front, with an adjusting head 7.3 disposed beneath it. The sensor head 7.2 contains a sensing device 7.21 which emits an electrical output signal. This sensing device may, for example, have a mechanical sensing member which reacts to change in the local transverse dimensions of the yarn. The sensing device may alternatively have an optical sensing member which reacts to changes in the local transverse structure of the yarn. Such sensing devices are described in more detail in DE-OS No. 36 28 654.

Inside the adjusting head 7.3, there is disposed a servomotor 7.31, whose output shaft 7.32 is at the outside of the adjusting head 7.3 and has a worm shaft 7.33 acting as a coupling member. As can be seen in FIGS. 3 and 4, the apparatus 7 is fitted in such a way that the adjusting head 7.3 is on a level with the thread guide eye 6 and the worm shaft 7.33 meshes with the gear wheel 6.4. The sensor head 7.2 is thus at a point above the thread guide eye 6 opposite the path of movement of the yarn Z. The electrical signal emitted by the sensing device 7.21 is fed by way of an amplifier 7.22 to an evaluation device 7.5. In thus evaluation device 5, the signal is investigated and analysed for periodic components. Thus, in a manner which is not shown, the component corresponding to the first subharmonic of the periodic input signal is used to produce a signal representing the difference in length between the two yarn components, which signal is compared with a desired value signal, which can be preset at the input. A control signal is then produced, which is used by way of a further amplifier 7.34 to control the servo motor 7.31, which displaces the eye part 6.1 until it is ascertained from the signal provided by the sensing device 7.21 by way of the evaluation device 7.5 that the desired value has been achieved.

The actual signal is displayed directly by a display device 7.4, which may, for example, be in the form of a screen, on the hand-operated instrument 7.

I claim:

1. An apparatus for automatically adjusting the tensile force ratio between axially moving outer and inner threads of cabled yarn during manufacture of such yarn in a cabling machine which includes axially-aligned spindle means and thread guide eye means for forming therebetween a rotating balloon of the axially moving outer thread, means for supplying the inner thread from within the outer thread balloon to a cording point below the thread guide eye means for winding the outer and inner threads about each other for cabling of the threads prior to passing through the thread guide eye means, and means for axially moving the thread guide eye means to vary the height of the thread balloon and the tensile force ratio between the outer and inner threads of the cabled yarn; said apparatus comprising means adapted to be positioned in the region of the thread guide eye means for measuring the actual tensile force ratio between the outer and inner threads, evaluation means operatively connected with said measuring means for comparing the measured tensile force ratio with a desired tensile force ratio and for producing an adjusting signal as a function of such comparison, and means operatively connected with said evaluation means and adapted to be cooperatively connected with the thread guide eye moving means for receiving the adjusting signal from said evaluation means and for cooperating with the thread guide eye moving means for automatically adjusting the axial position of the thread guide eye means to provide a desirable height of the thread balloon and a desirable outer and inner thread tensile force ratio.

2. An apparatus, as set forth in claim 1, in which the means for axially moving the thread guide eye means comprises a rack on the thread guide eye means and a rotatable gear wheel in driving engagement with the rack; and in which said means cooperating with the thread guide eye moving means for automatically adjusting the axial position of the thread guide eye means comprises a servomotor means for receiving and being operated by the adjusting signal from said evaluation means, and worm gear means driven by said servomotor means and adapted to engage and drive the rotatable gear wheel.

3. Apparatus, as set forth in claim 1, in which said measuring means comprising sensing means adapted to be positioned at a fixed point beyond the thread guide eye means in the path of the moving cabled yarn for measuring the difference in length between the outer and inner threads of the cabled yarn and for emitting an electrical output signal corresponding to such measurement to said evaluation means.

4. Apparatus, as set forth in claim 1, in which said apparatus further comprises means for visually displaying the comparison between the measured tensile force ratio and the desired tensile force ratio as determined by said evaluation means.

5. Apparatus, as set forth in claim 1, 2, 3 or 4 in which said apparatus comprises a hand-held and operated instrument which can be placed in the yarn cabling machine.

6. A hand-held and operated instrument for automatically adjusting the tensile force ratio between axially moving outer and inner threads of cabled yarn during manufacture of such yarn in a cabling machine which includes axially-aligned spindle means and thread guide eye means for forming therebetween a rotating balloon of the axially moving outer thread, means for supplying the inner thread from within the outer thread balloon to a cording point below the thread guide eye means for winding the outer and inner threads about each other for cabling of the threads prior to passing through the thread guide eye means, and means for axially moving the thread guide eye means to vary the height of the thread balloon and thus the tensile force ratio between the outer and inner threads of the cabled yarn including a rack on the thread guide eye means and a rotatable gear wheel in driving engagement with the rack; said instrument comprising a housing, sensing means carried by said housing and adapted to be positioned at a fixed point beyond the thread guide eye means in the path of the moving cabled yarn for measuring the actual tensile force ratio between the outer and inner threads by measuring the difference in length between the outer and inner threads of the cabled yarn and for emitting an electrical output signal corresponding to such measurement, evaluation means carried by said housing and operatively connected with said sensing means for receiving and comparing the electrical output signal indicating the measured tensile force ratio with a desired tensile force ratio and for producing an adjusting electrical signal as a function of such comparison, and means carried by said housing and comprising a servomotor means for receiving and being operated by the adjusting signal from the evaluation means, and worm gear means driven by said servomotor means and adapted to engage and drive the rotatable gear wheel of the thread guide eye moving means for adjusting the axial position of the thread guide eye means to provide a desirable height of the thread balloon and a desirable outer and inner thread tensile force ratio.

7. A method for adjusting the tensile force ratio between axially moving outer and inner threads of cabled yarn during manufacture of such yarn in a cabling machine which includes axially-aligned spindle means and axially movable thread guide eye means for forming therebetween a rotating balloon of the axially moving outer thread, and means for supplying the inner thread from within the outer thread balloon to a cording point below the thread guide eye means for winding the outer and inner threads about each other for cabling of the threads prior to passing through the thread guide eye means; said method comprising the steps of measuring the actual tensile force ratio between the outer and inner threads in the region of the thread guide eye means, comparing the measured tensile force ratio with a desired tensile force ratio, and adjusting the axial position of the thread guide eye means to provide a desired height of the thread balloon so that the measured tensile force ratio is the same as the desired tensile force ratio.

8. A method, as set forth in claim 7, in which said step of measuring the actual tensile force ratio between the outer and inner threads comprises determining the absolute values of the tensile forces of the outer and inner threads.

9. A method, as set forth in claim 7, in which said step of measuring the actual tensile force ratio between the outer and inner threads comprises determining the angle at which the outer and inner threads combine at the cording point.

10. A method, as set forth in claim 7, in which said step of measuring the actual tensile force ratio between the outer and inner threads comprises determining the difference in length between the outer and inner threads directly beyond the thread guide eye means by determining the twist structure of the yarn.

* * * * *

UNITED STATES PATENT AND TRADEMARK OFFICE

CERTIFICATE OF CORRECTION

PATENT NO. : 4,848,075

DATED : July 18, 1989

INVENTOR(S) : Johannes Frentzel-Beyme

It is certified that error appears in the above-identified patent and that said Letters Patent is hereby corrected as shown below:

On the cover page delete the title in its entirety and substitute therefor -- AN APPARATUS AND METHOD FOR ADJUSTING THE TENSILE FORCE RATIO BETWEEN THREADS DURING MANUFACTURE OF CABLED YARNS --.

Column 1, delete lines 2-7 (the title), and substitute therefor -- AN APPARATUS AND METHOD FOR ADJUSTING THE TENSILE FORCE RATIO BETWEEN THREADS DURING MANUFACTURE OF CABLED YARNS.--.

Column 2, lines 40-44, delete "The apparatus may preferably include means for visually displaying the comparison between the measured tensile force ratio and the desired tensile force ratio as determined by the cabling machine."

Signed and Sealed this

Twenty-sixth Day of June, 1990

*Attest:*

HARRY F. MANBECK, JR.

*Attesting Officer*

*Commissioner of Patents and Trademarks*